US012410550B2

(12) United States Patent
Leibman et al.

(10) Patent No.: US 12,410,550 B2
(45) Date of Patent: Sep. 9, 2025

(54) LAUNDRY APPLIANCE DOOR FOR TREATMENT OF NON-MOVING ARTICLES

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Jay Pareshbhai Shinde, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 306 days.

(21) Appl. No.: 17/994,851

(22) Filed: Nov. 28, 2022

(65) Prior Publication Data

US 2024/0175192 A1 May 30, 2024

(51) Int. Cl.

| | |
|---|---|
| ***D06F 39/14*** | (2006.01) |
| ***D06F 39/08*** | (2006.01) |
| ***D06F 58/20*** | (2006.01) |

(52) U.S. Cl.

CPC ..... *D06F 39/14* (2013.01); *D06F 39/083* (2013.01); *D06F 58/203* (2013.01)

(58) Field of Classification Search

CPC ..... D06F 58/203; D06F 39/14; D06F 39/083
See application file for complete search history.

(56) References Cited

U.S. PATENT DOCUMENTS

| | | | | |
|---|---|---|---|---|
| 3,267,701 | A * | 8/1966 | Mandarino | B05B 3/085 427/242 |
| 3,696,521 | A * | 10/1972 | Hubbard | D06F 58/04 366/234 |
| 5,884,506 | A * | 3/1999 | Blauert | D06F 39/088 68/17 R |
| 9,856,593 | B2 * | 1/2018 | Wishney | D06F 39/14 |
| 10,676,856 | B2 | 6/2020 | Woodham, Jr. et al. | |
| 10,731,285 | B2 | 8/2020 | Pieretti et al. | |
| 10,731,288 | B2 | 8/2020 | Hoffman et al. | |
| 10,738,406 | B2 | 8/2020 | Kim et al. | |
| 10,774,453 | B2 | 9/2020 | Erickson et al. | |
| 10,774,462 | B2 | 9/2020 | Ayers et al. | |
| 10,815,607 | B2 | 10/2020 | Costa et al. | |
| 10,837,135 | B2 | 11/2020 | Hendrickson et al. | |
| 10,907,288 | B1 | 2/2021 | Carpenter et al. | |
| 10,907,292 | B2 | 2/2021 | Harbrecht et al. | |
| 10,914,028 | B2 | 2/2021 | Gallagher et al. | |
| 10,982,374 | B2 | 4/2021 | Beres et al. | |
| 10,988,886 | B2 | 4/2021 | Jiang et al. | |
| 10,995,447 | B2 | 5/2021 | Beres et al. | |
| 11,008,691 | B2 | 5/2021 | Garnek et al. | |

(Continued)

FOREIGN PATENT DOCUMENTS

CN 110872767 B 2/2022

*Primary Examiner* — Benjamin L Osterhout
(74) *Attorney, Agent, or Firm* — Dority & Manning, P.A.

(57) ABSTRACT

A door assembly for a horizontal axis laundry appliance and a horizontal axis laundry appliance with the door assembly are disclosed. The door assembly includes a an appliance door with an outer face opposite and spaced apart from an inner face with the inner and outer faces defining a compartment. The compartment includes a door rotatably mounted to the appliance top provide selective access to the compartment. One or more nozzles are provided for selectively supplying a treatment fluid to the compartment.

16 Claims, 4 Drawing Sheets

(56) References Cited

U.S. PATENT DOCUMENTS

| | | | | |
|---|---|---|---|---|
| 11,021,832 | B2 | 6/2021 | Lee et al. | |
| 11,021,834 | B2 | 6/2021 | Ahamad et al. | |
| 11,028,514 | B2 | 6/2021 | Clara et al. | |
| 11,035,063 | B2 | 6/2021 | Alexander et al. | |
| 11,053,628 | B2 | 7/2021 | Alarcon et al. | |
| 11,060,224 | B2 | 7/2021 | Cannon et al. | |
| 11,066,774 | B2 | 7/2021 | Rios Acebal | |
| 2006/0150687 | A1* | 7/2006 | Chang | D06F 39/083 68/24 |
| 2007/0022788 | A1* | 2/2007 | Choi | D06F 39/02 68/17 R |
| 2010/0281925 | A1* | 11/2010 | Gokceimam | D06F 39/14 68/19 |
| 2017/0183803 | A1* | 6/2017 | Kim | D06F 39/14 |
| 2017/0306551 | A1* | 10/2017 | Kim | D06F 37/04 |
| 2018/0141089 | A1* | 5/2018 | Sawford | D06F 35/006 |
| 2020/0354878 | A1 | 11/2020 | Park et al. | |
| 2021/0010187 | A1* | 1/2021 | Cattorini | D06F 39/022 |
| 2022/0081823 | A1* | 3/2022 | Leibman | D06F 39/022 |
| 2022/0118129 | A1 | 4/2022 | Ramirez | |
| 2022/0162792 | A1* | 5/2022 | Rajendran | D06F 39/14 |

* cited by examiner

LAUNDRY APPLIANCE DOOR FOR TREATMENT OF NON-MOVING ARTICLES

FIELD OF THE INVENTION

The present disclosure relates generally to laundry appliances and more particularly to a laundry appliance door.

BACKGROUND OF THE INVENTION

Laundry appliances, such as front-loading appliances including washing machines, dryers, and combination washer/dryers typically comprise a treatment chamber formed, at least partially, by a rotating drum adapted to receive articles for washing, drying, or washing and drying. The rotating drum tumbles articles placed inside the drum to expose all surfaces to the treatment environment, for example washing fluids, drying air, or disinfecting sprays. Commonly, such laundry appliances have an access door to provide selective access to the treatment chamber, with the door pivotally attached to the appliance. To encourage turnover of the articles and urge the articles away at from the door and into the treatment chamber, the door may be formed with a convex, protruding shape or dome extending away from the inner face of the door and directed into the chamber when the door is closed. To enable observation of the interior of the drum, the dome may be formed from a clear material and a window provided on the outside surface of the door. A space is therefore formed and enclosed between the inside of the dome and the inside of the window.

Some laundry appliances provide the option to treat articles tumbling in the drum with a spray treatment. Some articles to be treated, for example by disinfecting sprays, cannot be turned over or tumbled in a rotating drum. Electronic devices, currency, eyewear, and other fragile or hard articles may be subject to damage if treated in a rotating drum, or may damage the drum itself. It may be desirable to keep such articles stationary during treatment and maintain them in an enclosed area to prevent unintended exposure to the disinfecting spray.

Accordingly, a laundry appliance having improved features for disinfecting stationary or non-moving articles is desirable. More particularly, a front-loading laundry appliance having an enclosed space or compartment between an inner face of an access door and an outside window, the compartment used to provide a disinfecting treatment to stationary articles, would be particularly beneficial.

BRIEF DESCRIPTION OF THE INVENTION

The present subject matter provides . . . Aspects and advantages of the invention will be set forth in part in the following description, may be apparent from the description, or may be learned through practice of the invention.

In one exemplary aspect, a door assembly for a horizontal axis laundry appliance comprising a cabinet including a front panel defining an opening and a drum positioned within the cabinet is provided. The door assembly comprises an appliance door having an inner face and an outer face opposite and spaced apart form the inner face, with the inner face and outer face defining a compartment. The assembly also comprises a compartment door rotatably mounted to the appliance door and movable between an open position and a closed position to provide selective access to the compartment. One or more dispensing nozzles are included in the door assembly for selectively applying a treatment fluid to the compartment.

In another example aspect, provided is a laundry appliance comprising a cabinet including a front panel defining an opening; a drum positioned within the cabinet; and a door assembly rotatably mounted to the cabinet proximate to the opening to permit selective access to the opening. The door assembly comprises an appliance door having an inner face and an outer face opposite and spaced apart from the inner face, with the inner face and outer face defining a compartment. The door assembly also comprises a compartment door rotatably mounted to the appliance door and movable between an open position and a closed position to provide selective access to the compartment. One or more dispensing nozzles are included in the door assembly for selectively applying a treatment fluid to the compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
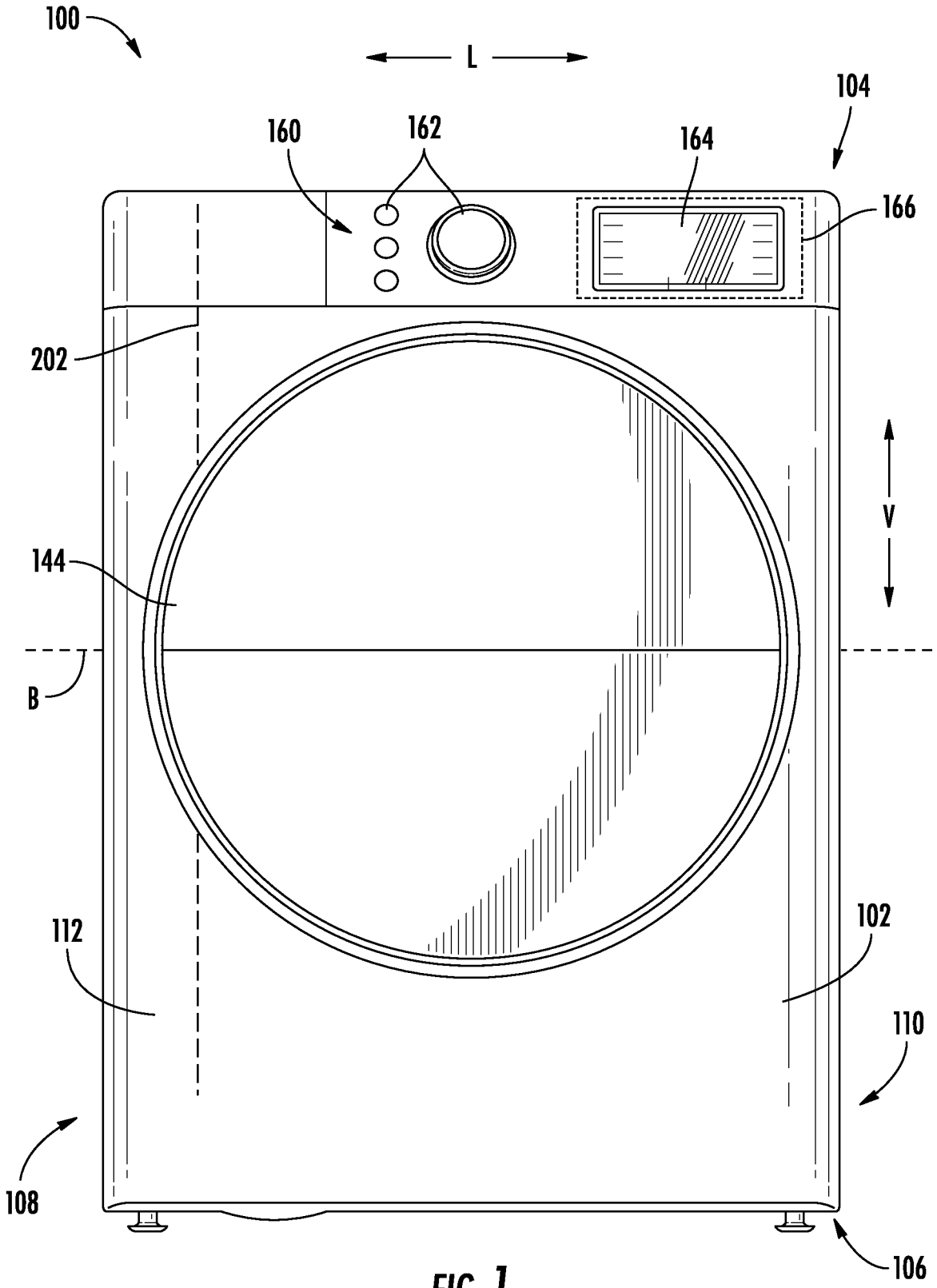
FIG. 1 provides a front view of a laundry appliance in accordance with embodiments of this disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
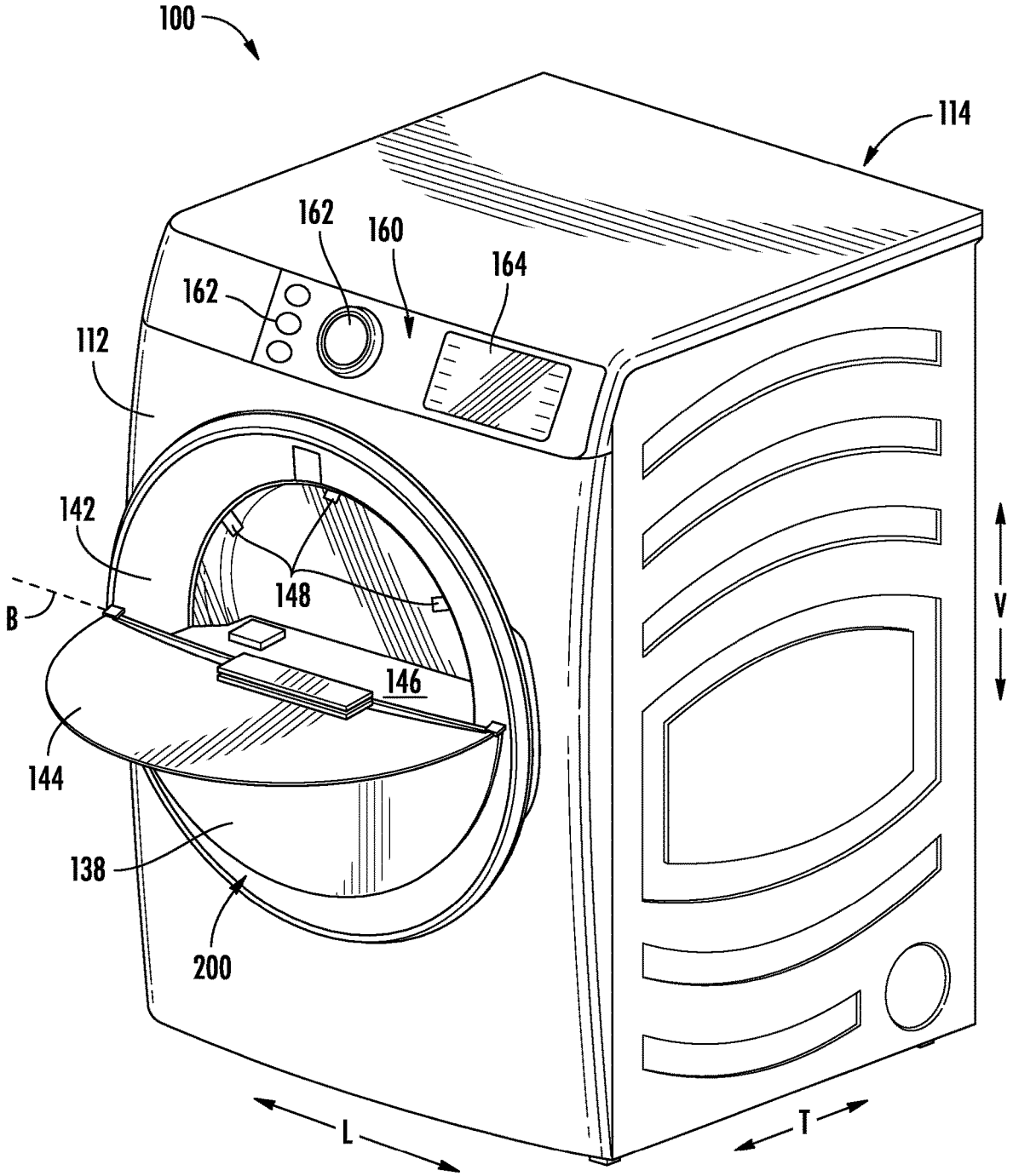
FIG. 2 provides a perspective view of the laundry appliance of FIG. 1 with the compartment door in the open position.

Turning to the figures, FIG. 1 provides a front view of an exemplary laundry appliance 100, for example a horizontal axis, or front-loading, laundry appliance. As illustrated in FIGS. 1 and 2, the laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along vertical direction V, between a left side 108 and a right side 110 along the lateral direction L, and between a front 112 and a rear 114 along the transverse direction T.

Figure 3:
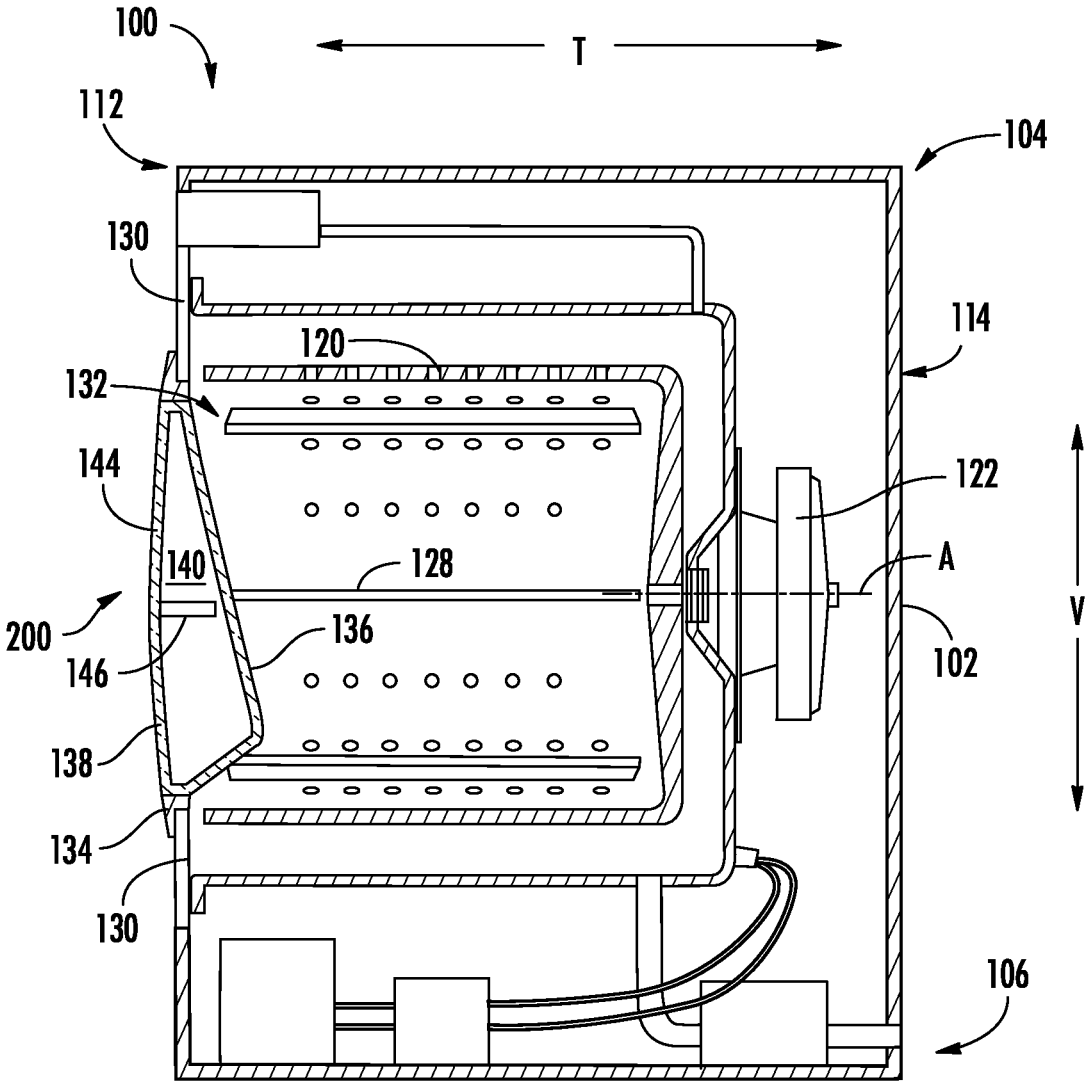
FIG. 3 provides a side cross-sectional view of a laundry appliance in accordance with an embodiment of this disclosure.

FIG. 3 represents an exemplary laundry appliance 100 in accordance with an embodiment of the present disclosure. While described and illustrated in the context of a specific embodiment of horizontal axis (i.e., front-loading) washing machine appliance, using the teachings disclosed herein it will be understood that a horizontal axis washing machine appliance is provided by way of example only. Other laundry appliances having different configurations, different appearances, and/or different features may also be utilized with the present subject matter as well, e.g., front-loading dryer appliances or front-loading combination washer/dryer appliances. Moreover, aspects of the present subject matter may be used in any other consumer or commercial appliance where it is desirable to facilitate treatment or disinfection of non-moving articles.

Referring to FIG. 3, a drum 120 is rotatably mounted within cabinet 102 such that it is rotatable about axis A, generally parallel to transverse direction T. A motor 122 is in mechanical communication with drum 120 to selectively rotate drum 120 during various laundry cycles (e.g., during agitation or rinse cycles of a washing machine or a drying cycle of a dryer appliance). Drum 120 may include one or more features that extend into the drum 120 to assist in agitating or turning over articles disposed within the drum 120. For example, as illustrated in FIG. 3, a plurality of ribs 128 extend from drum 120 into the interior of the drum. In this manner, the ribs 128 may lift articles disposed in the drum 120 to facilitate processing of articles in the laundry operation.

Referring generally to FIGS. 1, 2, and 3, cabinet 120 includes a front panel 130 which defines an opening 132 that permits user access to drum 120. More specifically, laundry appliance 100 includes an appliance door 134 (which may be part of a door assembly 200 as described in detail below) that is positioned over opening 132 and is rotatably mounted to front panel 130. More specifically, appliance door 134 is rotatable about door axis 202 (FIG. 1) that is substantially parallel to vertical direction V. In this manner, appliance door 134 permits selective access to opening 132 by being movable between an open position (not shown) and a closed position (FIGS. 1 and 3) blocking access to opening 132.

Figure 4:
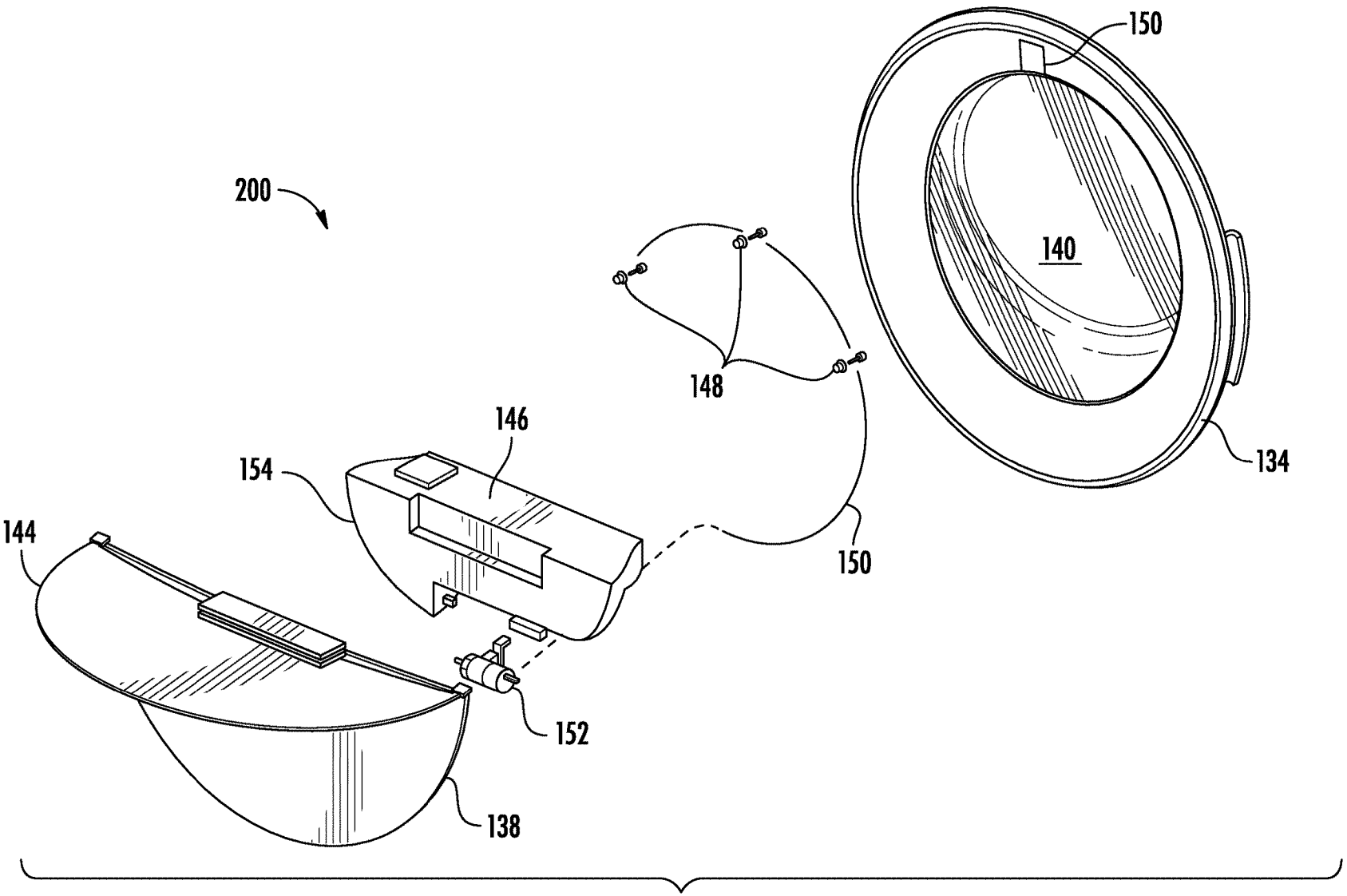
FIG. 4 provides an exploded view of a door assembly in accordance with an embodiment of this disclosure.

Referring now generally to FIGS. 2, 3, and 4, door assembly 200 will be described in more detail according to various embodiments of the present disclosure. Although the discussion below refers to illustrative door assembly 200, one of ordinary skill in the art will appreciate that the features and configurations described may be used for other door assemblies in other laundry appliances as well. For example, door assembly 200 may be positioned in another location within cabinet 102. Other variations and modifications of the exemplary embodiment described below are possible and such variations are contemplated as within the scope of the present disclosure.

As shown, for example in FIGS. 2 through 4, door assembly 200 includes appliance door 134. The appliance door 134 includes an inner face 136 that protrudes into the interior of the drum 120 when the appliance door 134 is in the closed position of FIG. 3. The protruding inner face 136 may facilitate turnover of articles placed within the drum 120 when the drum 120 is rotating about axis A. The inner face 136 may be dome shaped, bulbous in shape, angular, or a combination of these shapes to encourage article turnover and urge articles in the drum 120 away from the door assembly 200. In some embodiments, protruding inner face 136 may be formed from a transparent material, such as glass or plastic, to allow visibility into the drum 120.

Appliance door 134 of door assembly 200 may include an outer face 138 opposite and spaced apart from inner face 126, with a compartment 140 formed therebetween. In some embodiments, outer face 138 may be flat, or generally flat. In other embodiments, the outer face 138 may be outwardly convex (as shown in FIG. 3) away from the inner face 136. Outer face 138 of appliance door 134 may also be formed from a clear material to provide visibility into the drum 120 through the inner face 136. Similarly, clear outer face 138 may also provide visibility into compartment 140.

Outer face 138 may define a compartment opening 142 (FIG. 2) providing access to the compartment 140. Compartment opening 142 is illustrated as occupying an upper portion of the outer face 138. In other embodiments, the compartment opening 142 may be provided in other portions of the outer face 138 and may occupy a larger or smaller portion of the outer face 138. The outer face 138 may include a compartment door 144 rotatably mounted to the outer face 138. As illustrated, compartment door 144 is rotatable about axis B generally parallel with the lateral direction L. In other embodiments, the compartment door 144 may be rotatably mounted to the appliance door 134 and rotatable about other axes. Compartment door 144 may be rotatable between an open position (FIG. 2) providing access to the compartment 140 and a closed position (FIGS. 1 and 3) blocking access to the compartment 140.

In an embodiment, inner face 136 may define a compartment opening to provide access to the compartment 140. The inner face many include a compartment door rotatably attached to the inner face to selectively provide access or block access to the compartment 140.

The appliance door 134 may also include a handle (not shown) to facilitate opening and closing of the door 134 to access drum 120. Further, although appliance door 134 is illustrated as mounted to the front panel 130, it should be appreciated that the appliance door 134 may be mounted to another side of cabinet 102 or any other suitable support in alternative embodiments.

Distributed within compartment 140 may be one or more dispensing nozzles, nozzles 148, disposed on a portion of the appliance door 134 as illustrated in FIG. 2. In embodiments, nozzles 148 are fluidly coupled to a conduit 150 as illustrated in the exemplary embodiment of FIG. 4. FIG. 4 shows 3 nozzles spaced apart from each other and fluidly coupled to conduit 150 which may be a tube or hose suitable for carrying treatment fluid to the nozzles 148. In other embodiments, fewer or more than 3 nozzles may be provided. As shown, the nozzles 148 are connected in series to the conduit 150, with each nozzle fluidly coupled to at least one other nozzle. In other embodiments, each nozzle is separately coupled to a conduit 150.

In an embodiment, conduit 150 is fluidly coupled to a pump 152, the pump 152 fluidly coupled to reservoir 154. The reservoir 154 is configured to hold a quantity of treatment fluid. In the exemplary embodiment of FIG. 4, reservoir 154 and pump 152 are configured to be removably received within a portion of the compartment 140. In other embodiments, reservoir 154, or reservoir 154 and the pump 152, may be remotely located within the laundry appliance 100 with conduit 150 fluidly coupling the reservoir 154 to the pump 152 and a separate conduit(s) 150 coupling the pump to the nozzles 148. Reservoir 154 may be fluidly coupled to nozzles located elsewhere (not shown), for example in the drum 120, to treat articles suitable for tumbling, such as fabric articles.

As illustrated in FIGS. 2 and 3, a support shelf 146 may be provided within the compartment 140 such that an upper surface of the shelf 146 is accessible when the compartment door 144 is in the open position. In the exemplary embodiment of FIG. 4, a portion of reservoir 154 may provide the support shelf 146. As illustrated, the reservoir 154 may define the support shelf 146 as a generally horizontal portion at, or near, the vertically uppermost region of the reservoir 154, accessible when compartment door 144 is in the open position (FIG. 2). Support shelf 146 may be provided to support articles for treatment within compartment 140.

As perhaps best illustrated in the embodiment of FIG. 2, nozzles 148 may be directed towards support shelf 146. As illustrated, nozzles 148 are radially disposed and directed generally toward the support shelf 146. In this configuration, a treatment fluid, for example a disinfecting fluid, is drawn from the reservoir 154 by pump 152 fluidly coupled, directly or via a conduit 150, to the reservoir 154. The pump 152 pressurizes the fluid and distributes the pressurized fluid to the nozzles 148 via conduit 150. The nozzles 148 may be configured to receive the pressurized fluid and atomize the fluid into a fine spray or mist directed to the support shelf 146.

Articles may be placed on the support shelf 146 to receive the atomized treatment fluid dispensed by the nozzles 148 in a treatment cycle. As discussed above, the treatment fluid may be used elsewhere in the laundry appliance 100, such as in the drum 120 and tumbled by the rotation of the drum 120 about axis A. However, some articles are not suitable for tumbling. For example, hard objects, such as keys or coins, delicate articles such as electronic or eyewear, and paper currency may not be suitable for treatment in the drum 120. These and similar articles may be placed on the support shelf 146 and exposed to the atomized treatment liquid, for example a disinfectant, while remaining stationary or non-moving.

A control panel 160 including a plurality of input selectors 162 is coupled to front panel 130. Input selectors 162 may be any combination of buttons and selector knobs appropriate for user manipulation to control the operation of the laundry appliance 100. For example, a user may manipulate input selectors 162 to select various laundry appliance cycles such as washing, drying, or washing followed by drying in a combination machine. Treatment cycles for treating articles in the drum 120 or in compartment 140 with a treatment fluid may also be selected or programmed. Control panel 160 and input selectors 162 collectively form a user interface input for user selection of machine cycles and features. For example, in one embodiment, a display 164 indicates selected features, a countdown timer, and/or other data items of interest to machine users.

Operation of laundry appliance 100 is controlled by a controller or processing device 166 (FIG. 1) that is operatively coupled to control panel 160 and input selectors 162 for user manipulation to select laundry appliance cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

In many instances, it may be desirable to contain any treatment fluids used in the treatment of non-moving articles in compartment 140. Therefore it may be desirable to ensure compartment door 144 is in a closed position prior to, and during, any treatment cycle. To protect the user and the surrounding environment, embodiments of this disclosure include a door position switch or sensor 150 in communication with the controller 166. The sensor 150, shown schematically in FIG. 4, is configured to sense the compartment door 144 in the closed position (FIG. 3) and transmit a signal to the controller indicting the same. Unless the sensor 150 determines that the compartment door 144 is closed, the controller will not permit certain laundry appliance functions, such as non-moving article treatment, to initiate, or if already initiated, will terminate the function. One of ordinary skill in the art will recognize that any switch or sensor, including a position sensor, may be used to ensure that the compartment door 144 is closed during treatment operations.

Input selectors 162 may be manipulated by a user to instruct the laundry appliance to perform a particular non-moving article treatment cycle from a plurality of cycles. For example, cycles may be selected according to the construction or composition of the articles, the intensity of the treatment process sought, or the number of articles present to be treated. Feedback may be provided in response to the user's input on the display 164 and may include indication of the cycle selected, a cycle time display, or messages concerning the operation of the laundry appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A door assembly for a horizontal axis laundry appliance, the laundry appliance comprising a cabinet including a front panel defining an opening and a drum positioned within the cabinet, the drum defining an interior, the door assembly comprising:

an appliance door comprising an inner face and an outer face opposite and spaced apart from the inner face, the inner face and the outer face defining a compartment fluidly isolated from the interior of the drum;

a compartment door rotatably mounted to the appliance door and movable between an open position and a closed position to provide selective access to the compartment; and a support shelf provided within the compartment, the support shelf extending horizontally from the outer face of the appliance door into the compartment; and one or more dispensing nozzles configured for selectively supplying a treatment fluid to the compartment, wherein the support shelf is accessible when the compartment door is in the open position.

2. The door assembly of claim 1, wherein the outer face defines a compartment opening, the compartment door providing selective access to the compartment opening.

3. The door assembly of claim 2, wherein the compartment opening provides access to the compartment.

4. The door assembly of claim 1, wherein the treatment fluid is a disinfecting fluid, and the one or more dispensing nozzles selectively directs a spray of the disinfecting fluid to the support shelf.

5. The door assembly of claim 1, further comprising a reservoir within the compartment, the reservoir fluidly coupled to a pump to provide a pressurized flow of the treatment fluid.

6. The door assembly of claim 5, further comprising a conduit fluidly coupled to the pump and the one or more dispensing nozzles to provide the pressurized flow of the treatment fluid to the nozzles.

7. The door assembly of claim 6, wherein the pressurized flow of the treatment fluid is atomized by the one or more nozzles and directed to the support shelf.

8. The door assembly of claim 5, wherein a portion of the reservoir defines the support shelf.

9. A laundry appliance defining a vertical, a lateral, and a transverse direction, the laundry appliance comprising:

a cabinet including a front panel, the front panel defining an opening;

a drum positioned within the cabinet, the drum defining an interior; and a door assembly rotatably mounted to the cabinet proximate to the opening to permit selective access to the opening, the door assembly comprising:

an appliance door comprising an inner face and an outer face opposite and spaced apart from the inner face, the inner face and the outer face defining a compartment fluidly isolated from the interior of the drum; and a compartment door rotatably mounted to the appliance door and movable between an open position and a closed position; and a support shelf provided within the compartment, the support shelf extending horizontally from the outer face of the appliance door into the compartment; and one or more dispensing nozzles configured for selectively supplying a treatment fluid to the compartment, wherein the support shelf is accessible when the compartment door is in the open position.

10. The laundry appliance of claim 9, wherein the outer face defines a compartment opening, the compartment door providing selective access to the compartment opening.

11. The laundry appliance of claim 10, wherein the compartment opening provides access to the compartment.

12. The laundry appliance of claim 9, wherein the treatment fluid is a disinfecting fluid, and the one or more dispensing nozzles selectively directs a spray of the disinfecting fluid to the support shelf.

13. The laundry appliance of claim 9, further comprising a reservoir within the compartment, the reservoir fluidly coupled to a pump to provide a pressurized flow of the treatment fluid.

14. The laundry appliance of claim 13, further comprising a conduit fluidly coupled to the pump and the one or more nozzles to provide the pressurized flow of treatment fluid to the nozzles.

15. The laundry appliance of claim 14, wherein the pressurized flow of treatment fluid is atomized by the one or more nozzles and directed to the support shelf.

16. The laundry appliance of claim 13, wherein a portion of the reservoir comprises the support shelf.

* * * * *